US005946768A

United States Patent [19]

Kelly

[11] Patent Number: 5,946,768

[45] Date of Patent: Sep. 7, 1999

[54] MOBILE WORKSTATION WITH VACUUM UNIT

[76] Inventor: Michael D. Kelly, 8870 Tacoma St., Ventura, Calif. 93004

[21] Appl. No.: 08/818,012

[22] Filed: Mar. 14, 1997

[51] Int. Cl.[6] ..... A47L 5/38

[52] U.S. Cl. ..... 15/315; 15/310; 15/414; 15/334; 15/418

[58] Field of Search ..... 15/315, 314, 310, 15/414, 334

[56] References Cited

U.S. PATENT DOCUMENTS

| | | | |
|---|---|---|---|
| 913,966 | 3/1909 | Mohr . | |
| 1,055,977 | 3/1913 | Lasley | 15/315 X |
| 1,217,817 | 2/1917 | Peters | 15/315 X |
| 2,367,437 | 1/1945 | Salt . | |
| 2,623,234 | 12/1952 | Brown | 15/315 X |
| 3,009,188 | 11/1961 | Martin . | |
| 3,027,588 | 4/1962 | Bierstock | 15/414 X |
| 3,582,172 | 6/1971 | Clark . | |
| 3,739,421 | 6/1973 | Fukuba | 15/315 X |
| 3,885,714 | 5/1975 | Johnson . | |
| 3,994,042 | 11/1976 | Zakis . | |
| 4,019,219 | 4/1977 | Willenborg | 15/414 X |
| 4,549,329 | 10/1985 | St. Clair | 15/414 |
| 4,610,048 | 9/1986 | Ishihara et al. | 15/414 X |
| 4,989,291 | 2/1991 | Parent . | |
| 5,089,037 | 2/1992 | Marsolais . | |
| 5,205,013 | 4/1993 | Lopez . | |
| 5,269,073 | 12/1993 | Johnson . | |
| 5,377,383 | 1/1995 | Christensen | 15/353 |
| 5,740,581 | 4/1998 | Harrelson | 15/315 X |

FOREIGN PATENT DOCUMENTS

| | | | |
|---|---|---|---|
| 675552 | 12/1963 | Canada | 15/315 |

*Primary Examiner*—Chris K. Moore
*Attorney, Agent, or Firm*—Kenneth J. Hovet

[57] ABSTRACT

A workstation on wheels comprising a housing having a shelf dividing the housing interior into an upper and lower chamber. The shelf supports a vacuum unit that draws air from the lower chamber and exhausts it into the upper chamber. The lower chamber is provided with a vacuum outlet to which is connected an inelastic ductwork. The ductwork includes a nozzle for receiving air and solid materials from a floor surface. The air and solid materials flow through the ductwork and into a bag or bin in the lower chamber where the solid materials are accumulated. The ductwork is rotatable about the vacuum inlet and may be a one-piece L-shaped structure. Alternatively, it may be longitudinally adjustable by multiple interconnecting duct parts or by telescoping segments. The ductwork includes an housing duct to which is connected a valved flexible conduit for providing an auxiliary vacuum source.

24 Claims, 6 Drawing Sheets

MOBILE WORKSTATION WITH VACUUM UNIT

BACKGROUND OF THE INVENTION

1. Field of the Invention

The present invention pertains to workstations and, more particularly, to a movable workstation which is integrated with a vacuum source.

2. Description of Related Art

Workstations in the form of cabinets, supported by casters, rollers or wheels are well known in the art. However, when it was desired to incorporate a vacuuming means with the workstation, the prior art simply placed an independent vacuum unit behind doors of the rollabout cabinet. In all cases, the vacuum unit included flexible hoses whereby it was necessary to provide means for rolling up the hose or hanging it in some manner on the cabinet.

U.S. Pat. No. 5,089,037 describes a mobile vacuuming apparatus wherein a barrel-like vacuum cleaner is positioned on a cart between opposing cabinets. The cabinets include large external hooks for supporting the vacuum hose. In this way, the cart could be moved without the hose dragging behind.

An improvement on the above apparatus is shown in U.S. Pat. No. 4,989,291. This patent discloses a computer servicing cart having an interior compartment for storing a bulky vacuum hose. In use, the hose is removed and connected to an outlet on the side of the cart housing. The independent vacuum unit itself rests within a cabinet on the cart and accessories such as a brush are stored on hooks within the compartment. As a result of carrying all the above including supplies and tools, the cart is large, heavy, unwieldy and barely mobile.

It is, therefore, an object of the present invention to create a light, compact, readily movable workstation that provides not only space for implements and supplies, but an integrated vacuum source. It is also an object of the invention to provide a vacuum means that does not require separate hose compartments and exterior unattractive hook assemblies upon which a vacuum hose must be looped.

SUMMARY OF THE INVENTION

The present invention provides a housing on wheels having a level work surface and convenient holding means for storing equipment and tools. The housing interior includes defined chambers for the integration of a vacuuming unit.

The housing exterior is equipped with a vacuum means comprising an exterior air inlet means and a housing intake member. The air inlet means is suitably distanced from a directed surface, e.g., a floor, to accept the intake of air and solid materials such as hair and debris particles. It may include an obtusely angled segment with a nozzle entry and an adjustment means for regulating the volumetric intake space of the nozzle.

The intake member is angularly adjustable and may comprise a one-piece ductwork or multiple interfitting duct parts which are longitudinally adjustable. It includes a housing duct from which concentric or telescoping coupling parts may extend. The housing duct passes into the housing through a vacuum outlet for communication with the internal vacuum unit. This construction creates a continuous passageway for traversing vacuumed material into the internal vacuum unit.

The intake member may further include an auxiliary flexible vacuum means comprising a conduit. In such case, the intake member will be provided with a valve means for regulating air flow into the flexible conduit.

The vacuum unit comprises a vacuum motor, fan and filter contained within a shell secured to a housing interior shelf structure. A container means, suitable for collecting the solid materials, accesses the filter, but is otherwise separately positioned within the housing. The container means is removable from the housing so that it may be emptied or discarded.

The container means may comprise a flexible bag engaged to an interior fitment extending from the outlet duct. Alternatively, the container means may comprise a slide-out bin. The bin may be sealingly engaged to the housing.

DESCRIPTION OF THE PREFERRED EMBODIMENTS

Figure 2:
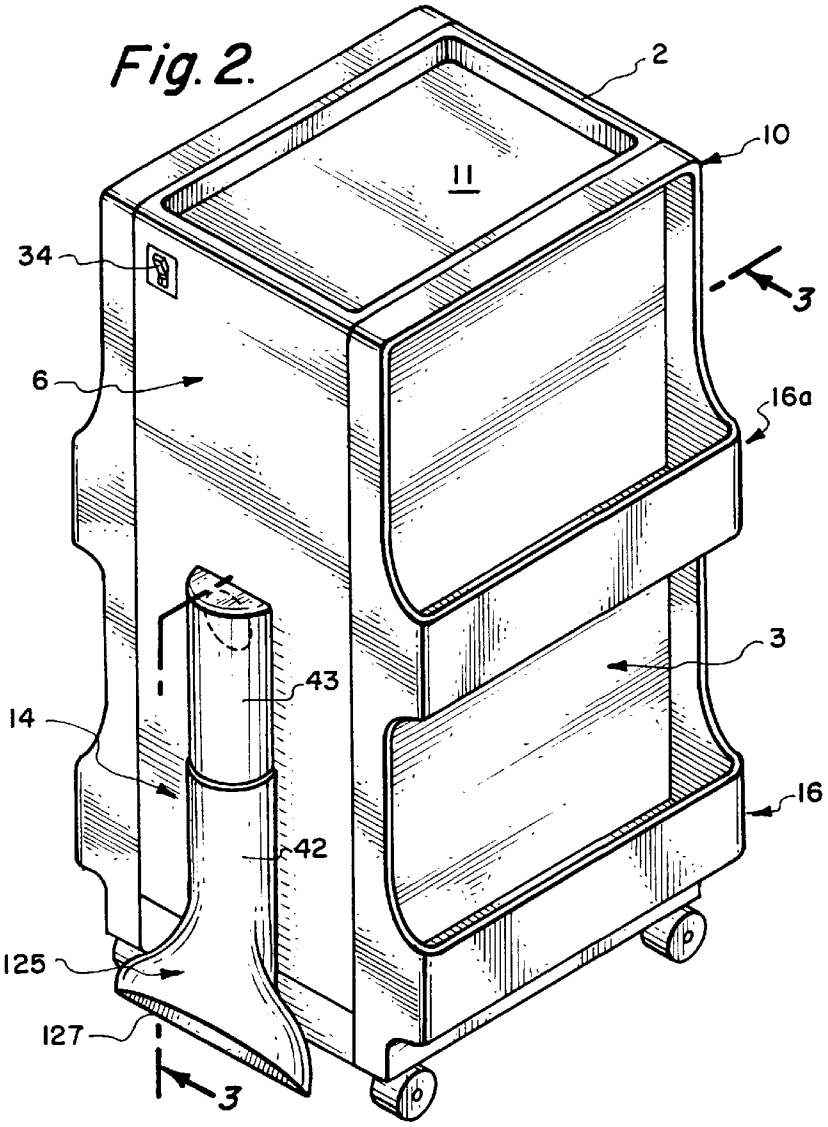
FIG. 2 is an isometric left front view of the invention shown in FIG. 1.
Figure 1:
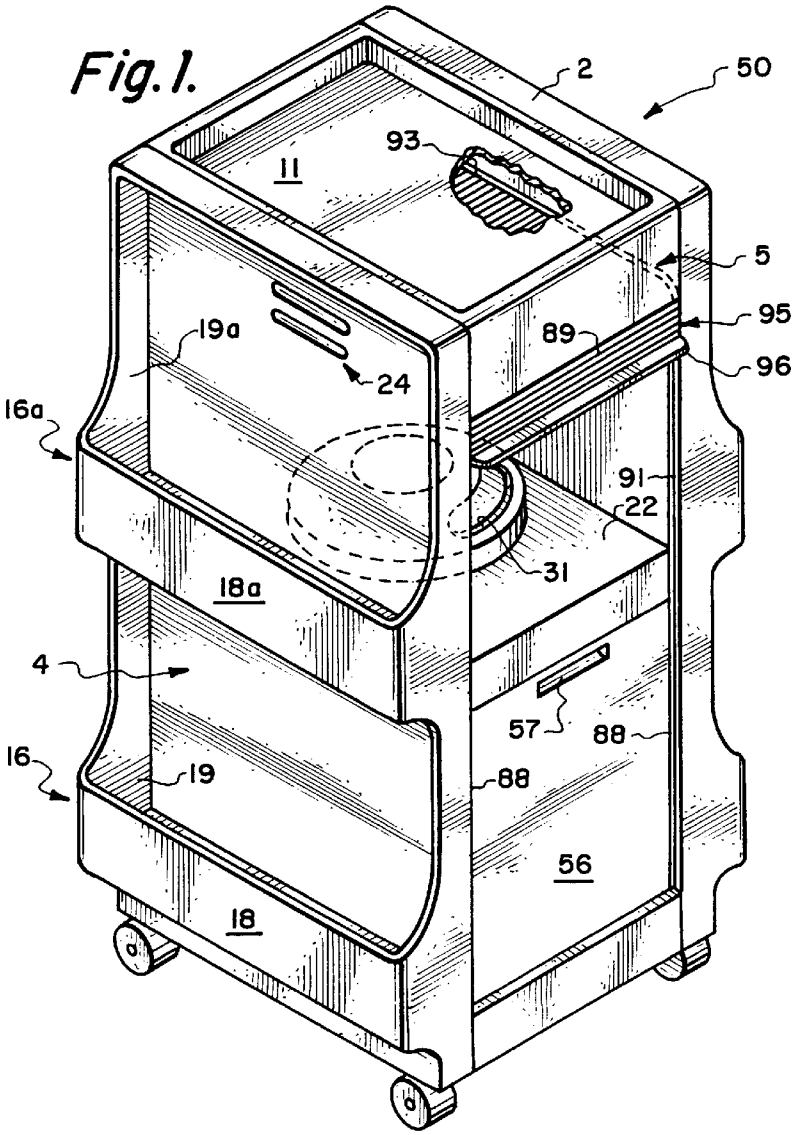
FIG. 1 is an isometric right rear view of the invention with an internal vacuum unit shown in phantom.

With attention now to FIGS. 1 and 2, reference number 50 shows a mobile vacuuming workstation operational on a directed surface such as floor 7. The workstation includes housing 10 having a top surface 2 with a flat recessed area 11. The recessed area is used as a work surface and for holding tools, equipment or workpieces. A pair of lower and upper side trays 16,16*a*, suitable for holding tools, bottles and supplies are shown mounted to respective right sidewall 3 and left sidewall 4 of the housing. As shown, the side trays are integrated with the housing structure. The trays include vertical front lower and upper barriers 18,18*a* and lower and upper side barriers 19,19*a* for constrainment of the tools, bottles and supplies.

The housing may be round, oval or rectangular in overall shape. It is supported by roller means shown as wheel assemblies 26 attached to housing understructure 27. Casters and pivot balls could also be used as a roller means.

The housing interior may be accessed by hinged doors, sliding partitions or a flexible roll door. FIG. 1 shows a roll door 95 positioned within an opening in housing back wall 5. The door is segmented by hinged lateral slats 89. Opposing edge portions of the slats slidably engage slots 91 extending along each opposing vertical edge 88 of the housing door opening. Horizontal slat guides 93 are located along opposing inner sidewall surfaces of the housing to accommodate the door when in an elevated position as shown in FIG. 1. To facilitate movement, the roll down door is provided with an outwardly extending door handle 96.

FIGS. 2, 3, 5 and 7 show details of the vacuum means for traversing air and debris materials from the directed surface to the vacuum source in the interior of the housing. The vacuum means is constructed of an inelastic material as distinguished from a flexible conduit or stretchable hose. In this way, it will have structural integrity and be an associated part of the housing. Overall, the vacuum means comprises either a single ductwork or an assembly of adjustable and disengageable hollow parts.

Figures 7, 8:
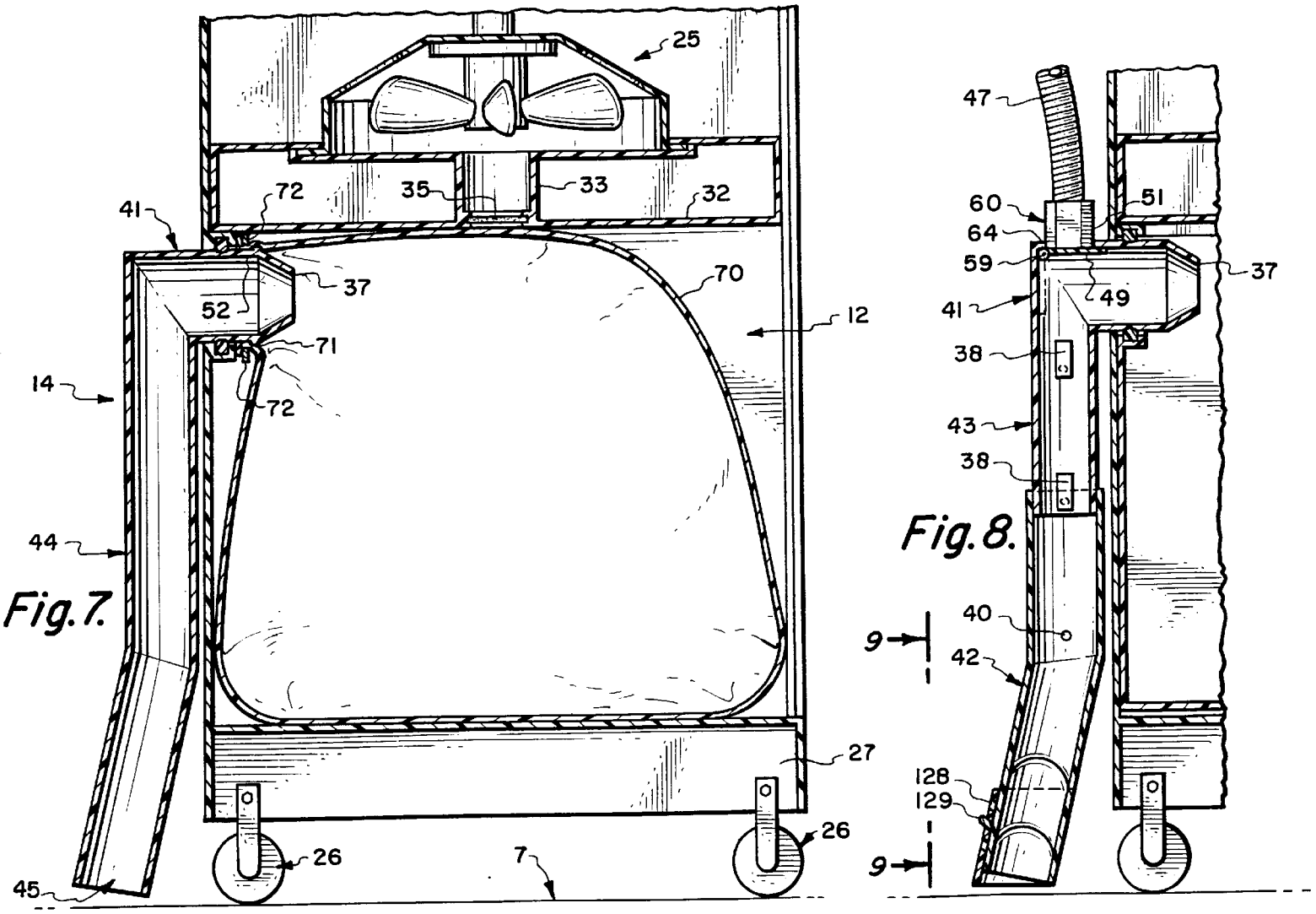
FIG. 7 is a view similar to FIG. 3 showing an alternative debris container means and an alternative intake member.
FIG. 8 is a fragmentary cross-sectional view showing a modified intake member with an auxiliary flexible intake conduit and the vacuum means of FIG. 3 with a movable inlet shield for varying the debris intake space forward of the inlet opening.

As shown in FIG. 7, the vacuum means provides an intake member 14 comprising the combination of housing duct 41 that extends through vacuum outlet 8 proximate the lower midportion of housing front end 6 and a ductwork 44 which extends downwardly from the housing duct to an inlet means shown as duct inlet 45 proximate floor 7. In this embodiment, the intake member comprises an L-shaped one-piece hollow structure.

Figure 3:
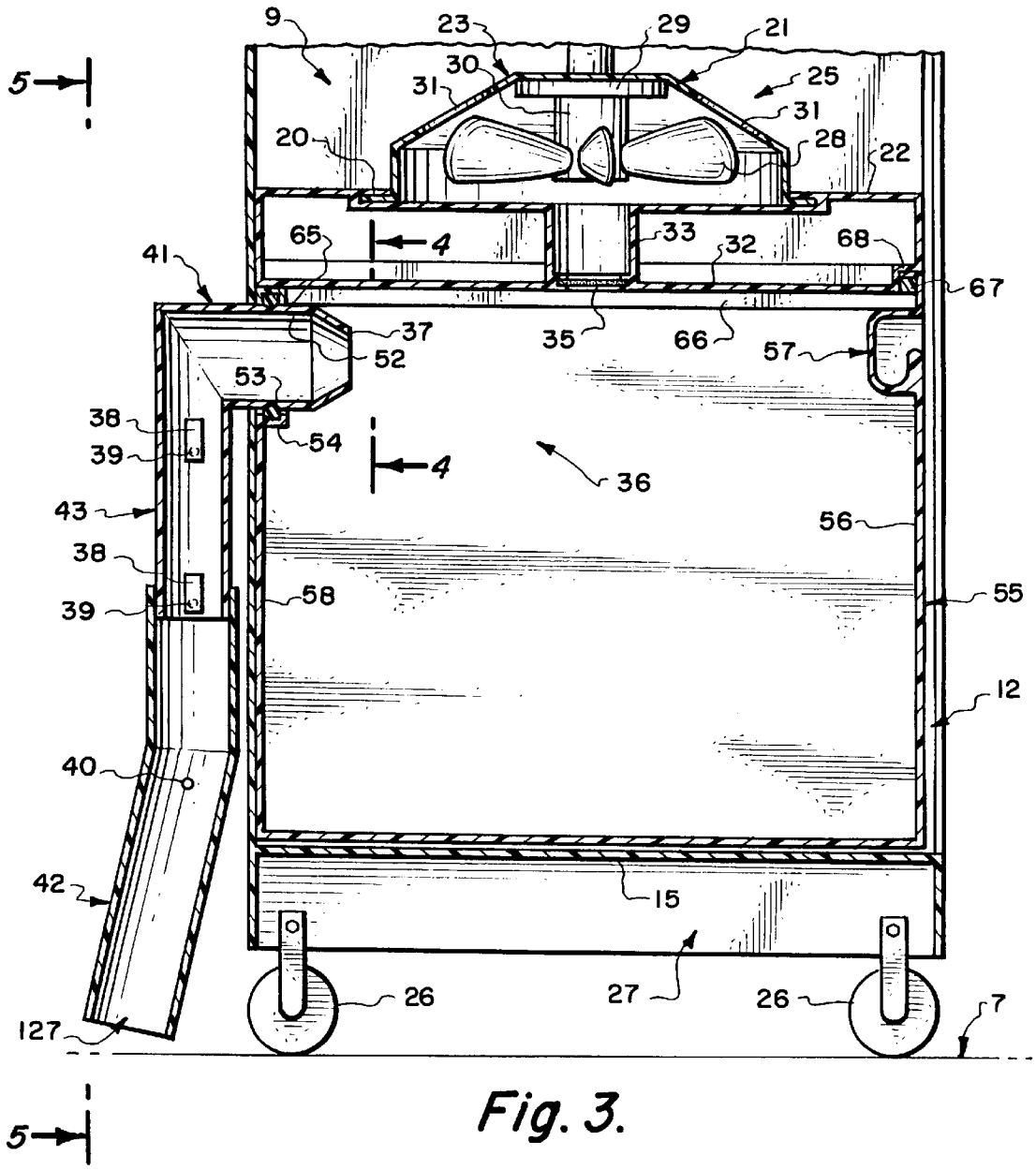
FIG. 3 is an enlarged cross-sectional view taken along lines 3—3 of FIG. 2.
Figure 4:
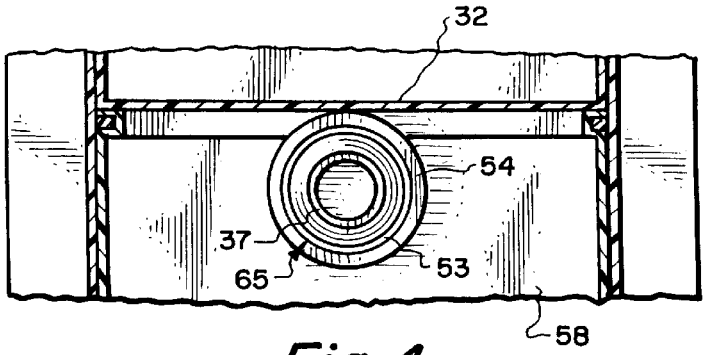
FIG. 4 is a fragmentary cross-sectional view taken along lines 4—4 of FIG. 3.
Figure 5:
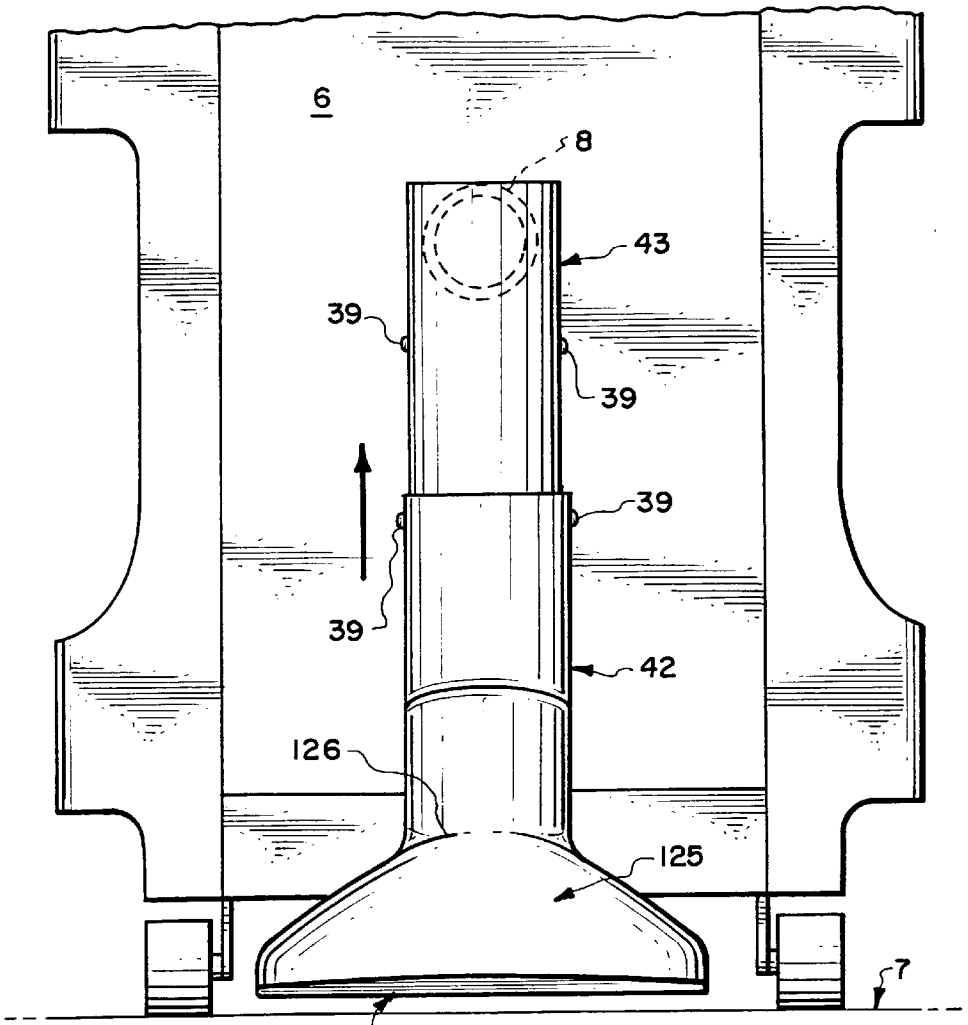
FIG. 5 is an enlarged front end elevational view taken along lines 5—5 of FIG. 3.

Alternatively, the intake member may comprise two or more adjoining concentric parts such as that illustrated in FIGS. 3, 5 and 8. As shown, housing duct 41 merges into a downwardly extending connector segment 43. This segment terminates proximate the lower midsection of the lower half of the front wall 6. The connector segment is provided with attachment means shown as deflectable strips 38 located opposite each other in pairs on the inside surface of the segment. One end of each strip is secured to the segment inside surface while the other end is provided with a button 39 extending outwardly through an associated wall aperture. The buttons are thereby able to engage corresponding button openings 40 in lower duct 42. The lower duct has a cross-section that is concentric to the connector segment with an inner diameter slightly larger than the corresponding diameters of said segment. In this way, it can slip over the free end portion of the connector segment and become releasably engaged thereto by having a lower pair of buttons 39 engage a corresponding upper pair of openings 40 in the lower duct.

As best seen in FIGS. 3, 5 and 8, the strip pairs are longitudinally offset. This provides for two vertical positions for the lower duct although other strips and longitudinal positions of the lower duct are within the scope of the invention.

The lower duct terminates at the inlet means shown as nozzle 125. The nozzle is depicted as being integral with the lower duct. However, it could be separable via a friction joint 126 at a neck portion juncture with the lower duct. The nozzle includes oblong opening 127 which is sized to allow passage of air and solid material such as small masses of hair.

Figure 6:
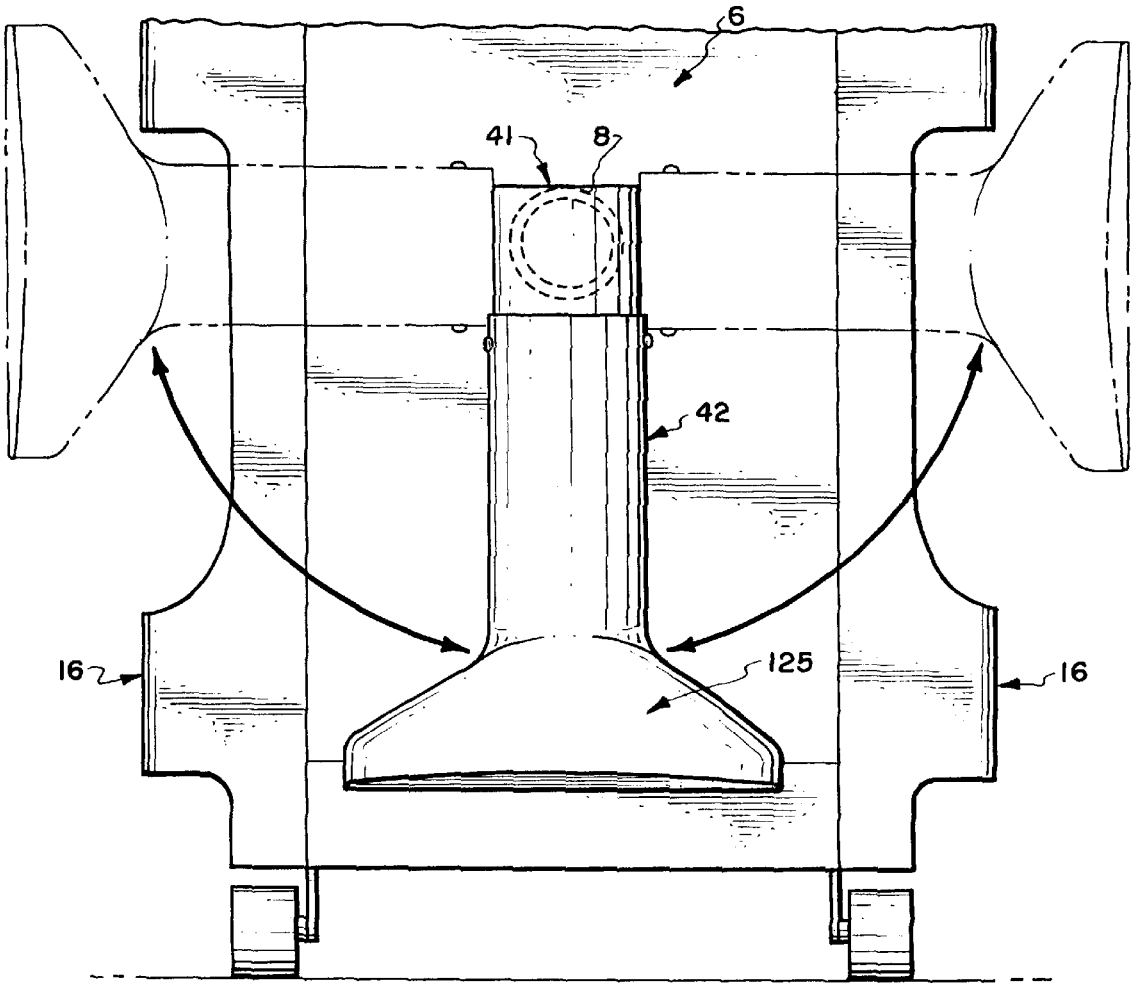
FIG. 6 is a view similar to FIG. 6 showing angular and longitudinal adjustment of the vacuum means.

With reference to FIG. 6, the lower duct is engaged in an uppermost position over connector segment 43. This position facilitates rotation about the center axis of housing vacuum outlet 8. Angular positioning is accomplished by a relatively tight concentric frictional engagement between housing duct 41 and sealing ring 53. The sealing ring is located within annular trough 54 which extends from front bin panel 58 adjacent outlet 8. The frictional engagement is sufficiently tight to allow rotational movement while holding the intake member in the left and right horizontal alignments depicted in phantom in FIG. 6.

Figure 9:
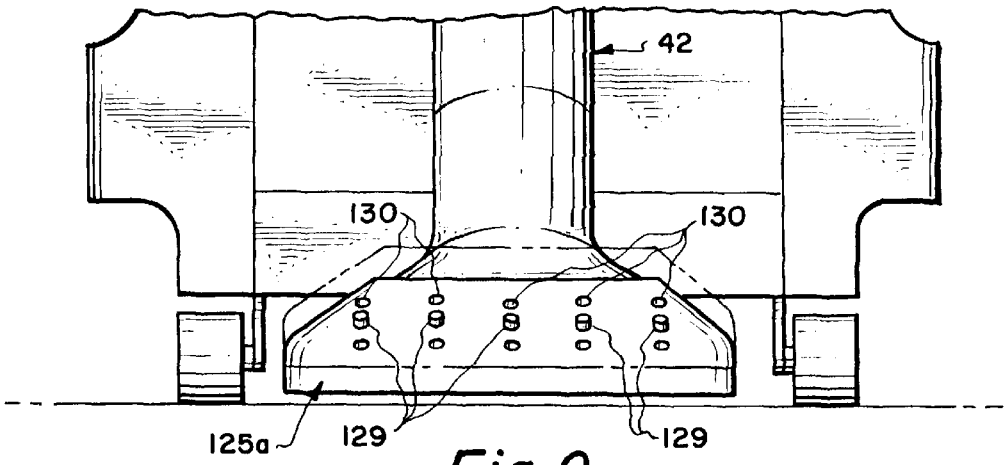
FIG. 9 is a fragmentary front elevational view taken along lines 9—9 of FIG. 8 showing adjustment of the inlet shield in phantom.

FIGS. 8 and 9 show nozzle 125*a* equipped with adjustment means for varying the debris intake space forward of the inlet opening 127. As used herein, the phrase "debris intake space" constitutes the area of exposure between floor 7 and the forward edge of opening 127. The adjustment means comprises a movable shield 128 releasably attached to the outer surface of the nozzle. Across the nozzle outer surface are multiple pegs 129 aligned in a row. The shield has corresponding peg openings 130 aligned in rows which are horizontally spaced-apart. To diminish the size of the intake space, the pegs are inserted into the uppermost row of shield peg openings. To increase the intake space, the shield is elevated and secured by engaging a lower row of openings with the pegs.

With further reference to FIG. 8, a flexible conduit 47 is shown attached to the upper exterior wall 64 of housing duct 41. Threaded bushing 48 at the conduit proximal end engages boss 51 extending upwardly from the aforesaid exterior wall 64. The boss includes air aperture 60 which is closeable by a valve means shown as flap member 49. A flap hinge 59 and flap control lever (not shown) are located at the juncture of the connector segment and housing duct. The flap member rotates about the hinge upon actuation of the lever. It overlies the aperture when the flexible conduit is not being used. Otherwise, it can lie flat against the inner wall of connector segment 43, as shown in phantom, or at some angular position in between the closed and open positions.

The distal free end of the conduit (not shown) is used to vacuum implements and top surface areas of the housing. It may have sufficient length to remove loose hair from a person's shoulders and neck.

FIG. 3 illustrates a vacuum unit 25 mounted within upper internal chamber 9 of the housing. An interior horizontal shelf 22 extends across the housing interior cross-section and supports the overall unit. As shown, a domed shell 23 having a lower peripheral flange 20 extends through a central opening in the shelf. The flange is secured to the shelf underside to uphold the vacuum unit. The upper portion 21 of the shell includes fan vents 31 to permit exhaust air to flow from the fan into upper chamber 9. Either one or both of the housing sidewalls or endwalls may include a vent. As shown, exhaust vents 24 are located in the upper portion of left wall 4.

The interior shelf 22 includes a spaced-apart underlying wall 32 that is coextensive with shelf 22. A central vacuum intake conduit 33 spans the space between the shelf and the underlying wall. The intake conduit is located beneath fan 28 to efficiently draw air from lower chamber 12 of the housing. An air filter 35 fits into or overlies the conduit to prevent fine particles from accessing the fan.

As best shown in FIGS. 3 and 7, the fan extends from fan motor 30 which is attached to pedestal 29. The pedestal, in turn, is mounted to the underside of upper shell portion 21. Although it could be operated by DC current from batteries located within the housing, most typically the fan motor will operate from a normal AC power source. A fan on-off switch 34 is located for convenience on the upper portion of housing front wall 6.

With further reference to FIGS. 3 and 7, the spaced-apart arrangement of intake conduit 33 and duct opening 37 in lower chamber 12 provides a region 36 of low velocity air. This region encompasses the upper space of lower chamber 12 wherein air velocity will be considerably diminished as it exits the duct opening 37. This is because of the larger volume of the region as compared to the duct outlet size. As a result of the lower velocity, most materials having a density greater than air will fall out of the vacuum airstream.

To receive and accumulate the fallout materials, a container means is located below region 36. As shown in FIG. 3, such means comprises a slide-out bin 55. The bin has an open top but could be partially enclosed or enclosed with vents. It conforms in size and shape to lower chamber 12 and rests upon bottom wall 15 of the housing. It includes rear panel 56 having a handle 57 for manually sliding the bin in and out of the chamber.

The bin also includes the aforementioned front panel 58 having a panel opening 65 defined by the above-described annular trough 54 and sealing ring 53. The ring permits sealing engagement with the panel opening when the bin is moved into and out of the lower chamber to unload accumulated solid materials.

For efficient vacuum operation, the bin may be provided with a peripheral flange 66 about its upper edge. The flange sealingly engages gasket 67 contained within wall notch 68. The notch and seal extend about the entire periphery of underlying wall 32 to inhibit leakage of air into the bin and lower chamber 12.

An alternative containment means comprising porous bag 70 is shown in FIG. 7. In this embodiment, the bag may be large enough to fill much of the volume of the lower chamber. It includes a neck region 71 that sealingly encircles inner extension 52 of housing duct 41. To secure the bag inlet and prevent its dislodgement from the inner extension, a resilient ring clamp 72 may be used. Other means such as a drawstring or elastic band could also be utilized.

In operation, the vacuum unit will draw air via conduit 33 through the porous walls of the bag. The bag porosity permits the vacuum airstream to pass through the bag wall and entrain solid materials from a directed surface into inlet 45, through duct 44 and through duct opening 37. The solid materials will be constrained within the bag while the air passes through the bag to the vacuum fan. When the bag is reasonably full, clamp 72 may be loosened and the bag removed from the chamber for replacement via door 95.

With respect to the use of bin 55, it is not essential that the housing be substantially airtight. Thus, the door opening and door are optional. If desired, a door could be provided enclosing the open area above shelf 22. This would provide convenient access for the vacuum unit 25.

Figure 10:
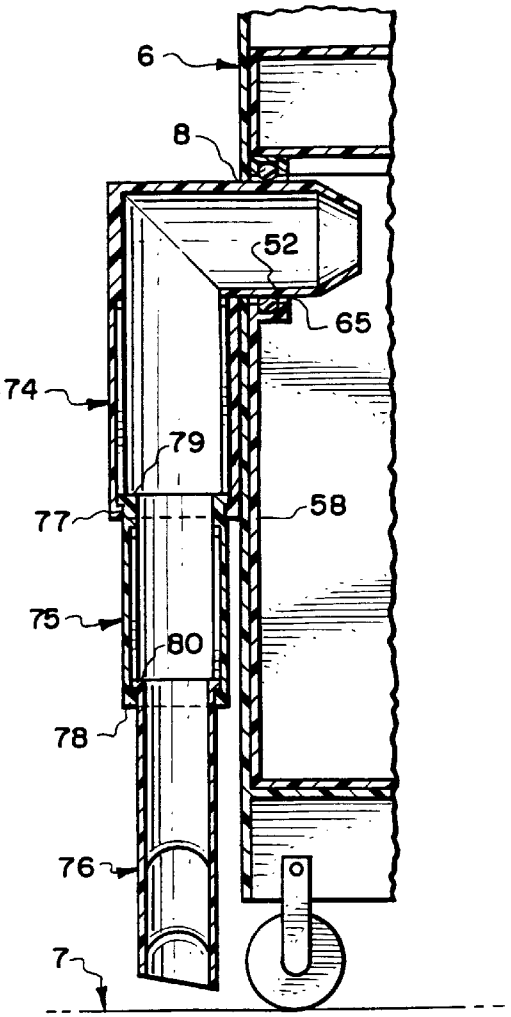
FIG. 10 is a fragmentary cross-sectional view similar to FIG. 8 showing a telescoping means for longitudinal adjustment of the intake member.
Figure 12:
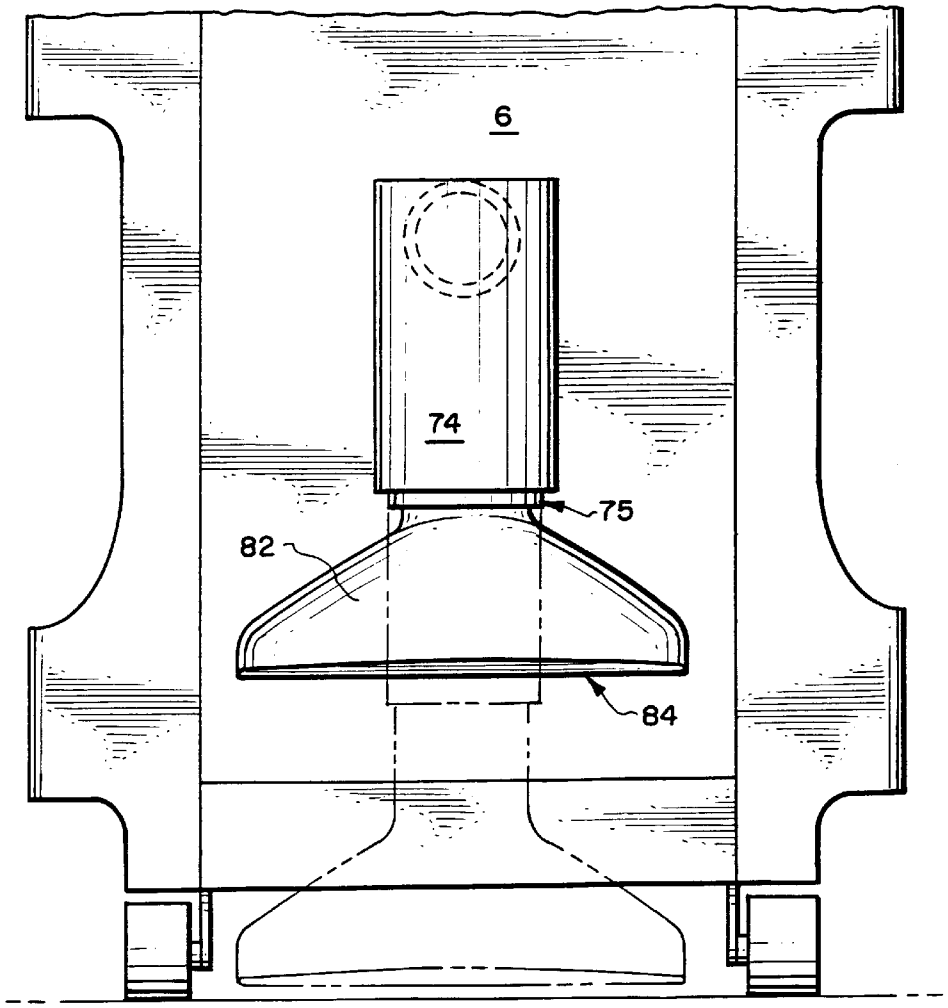
FIG. 12 is a front elevational view taken along lines 12—12 of FIG. 11 showing longitudinal movement of the telescoping means in phantom.
Figure 11:
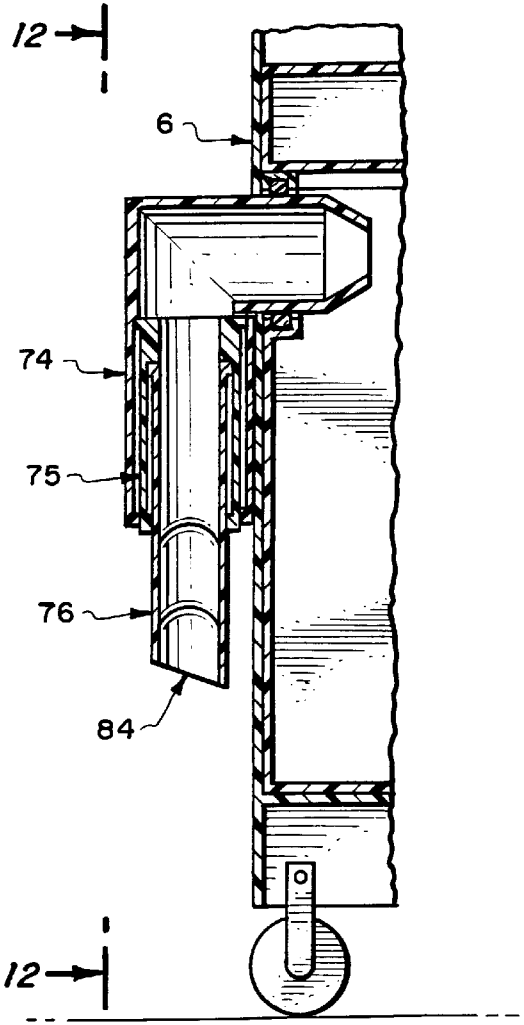
FIG. 11 is a fragmentary cross-sectional view similar to FIG. 10 showing the telescoping means in a retracted position.

FIGS. 10–12 show a version of the intake member comprising a telescoping means. The telescoping means comprises a modified connector segment shown as telescope segment 74 to which is slidably attached a middle segment 75 and a lower segment 76. The lower end of both the telescope segment and middle segment are provided with inwardly directed annular shoulders shown as connector shoulder 77 and middle shoulder 78. The connector shoulder engages a middle rib 79 extending around the top portion of middle telescope segment 75. Likewise, lower segment 76 is provided with an outwardly extending annular rib shown as lower rib 80 which is adapted to engage middle shoulder 78.

The diameter of middle segment 75 is slightly less than telescope segment 74. And, lower segment 76 has an outside diameter somewhat less than the inside diameter of middle segment 75. Thus, when fully retracted as shown in FIG. 11, the lower segment will be constrained by frictional engagement within the a inside of middle segment 75. Likewise, the outer diameter of middle segment 75 is slightly less than the inner diameter of telescope segment 74. As such, the middle and lower segments may be collapsed entirely within the telescope segment as shown in FIG. 11 and as depicted in FIG. 12.

The free end of the lower segment includes telescope nozzle 82 having a telescope inlet 84. The nozzle may be removable from the lower segment or be can integral part thereof. As shown, the telescope nozzle and inlet are similar to nozzle 125 and oblong opening 127. The telescope nozzle could also include an adjustment means for varying the debris intake space as previously described in relation to FIG. 9.

The above-described invention has particular utility in workplaces that utilize specialized implements and preparations typically found in a beauty salon or barber shop. It is expected that the workstation can be rolled to a location adjacent where the barber or hair stylist is working so that preparations contained in the housing side trays are readily accessible and wherein the recessed area 11 can be used as a flat working surface. Floor debris and loose hair are readily removed by use of the vacuum means into which the debris and loose hair may be swept directly into the duct inlet 45 or nozzle inlet 127. Alternatively, the overall housing can be moved about for directing the vacuum intake over a floor where debris is located. If any implements or personal cleaning is required, the auxiliary vacuum means comprising flexible conduit 47 may be used.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiments, but only by the scope of the appended claims.

I claim:

1. A workstation comprising:

a housing having a vacuum outlet and an interior chamber;

a vacuum source in communication with said vacuum outlet;

a vacuum means extending from said outlet for evacuating air and solid material from a directed surface comprising an intake member with an inlet means comprising a nozzle having a nozzle opening for receiving said air and solid material, said intake member including a passageway in communication with said inlet means and said vacuum outlet, said nozzle including adjustment means for varying the debris intake space of said nozzle opening comprising a shield releasably attached to said nozzle at predetermined positions in relation to said nozzle opening.

2. The workstation of claim 1 wherein said intake member includes a housing duct attached to said vacuum outlet, said passageway extending from said housing duct to said inlet means.

3. The workstation of claim 2 wherein said ductwork is segmented into two or more duct parts held together by an attachment means.

4. The workstation of claim 2 wherein said ductwork comprises two or more telescoping segments.

5. The workstation of claim 2 wherein said housing duct is rotatable about the center axis of said vacuum outlet.

6. The workstation of claim 2 including a container means in communication with said housing duct for receiving said air and solid material.

7. The workstation of claim 6 wherein said container means is selected from the group consisting of a bin and a porous bag.

8. The workstation of claim 1 including a container means in communication with said vacuum outlet and said vacuum source for receiving said air and solid material.

9. A workstation comprising:

a housing with an interior shelf which separates the housing interior into an upper chamber and a lower chamber, said housing having a vacuum outlet in communication with said lower chamber;

a vacuum source in communication with said vacuum outlet;

a ductwork in communication with said vacuum outlet having an inlet means for drawing-in air and solid material from a directed surface, said vacuum source comprising a vacuum unit secured to said shelf for creating a vacuum in said lower chamber; and, a container means in communication with said vacuum outlet for receiving said air and solid material, said container means being located in said lower chamber and being selected from the group consisting of a bin and a porous bag.

10. The workstation of claim 9 wherein said ductwork is segmented into at least two duct parts held together by an attachment means.

11. The workstation of claim 9 wherein said ductwork comprises at least two telescoping segments.

12. The workstation of claim 9 wherein said inlet means comprises a nozzle having a nozzle opening.

13. The workstation of claim 12 wherein said nozzle includes adjustment means for varying the debris intake space of said nozzle opening.

14. The workstation of claim 9 wherein said ductwork includes an housing duct rotatably connected to said vacuum outlet.

15. The workstation of claim 14 wherein said housing duct includes an auxiliary vacuum means comprising a flexible conduit in communication with said ductwork.

16. The workstation of claim 15 wherein said auxiliary vacuum means includes a valve means for regulating air flow between said ductwork and said flexible conduit.

17. A workstation comprising:

a housing with an interior shelf which separates the housing interior into an upper chamber and a lower chamber, said housing having a vacuum outlet;

a vacuum source in communication with said vacuum outlet; and, a ductwork in communication with said vacuum outlet having an inlet means for drawing-in air and solid material from a directed surface, said ductwork including a housing duct rotatably connected to said vacuum outlet, said housing duct having an auxiliary vacuum means comprising a flexible conduit in communication with said ductwork.

18. The workstation of claim 17 wherein said auxiliary vacuum means includes a valve means for regulating air flow between said ductwork and said flexible conduit.

19. A workstation comprising:

a housing with an interior shelf which separates the housing interior into an upper chamber and a lower chamber, said housing having a vacuum outlet;

a vacuum source in communication with said vacuum outlet, said vacuum source exhausting air into said upper chamber and out through a housing vent; and, a ductwork in communication with said vacuum outlet having an inlet means for drawing-in air and solid material from a directed surface.

20. The workstation of claim 19 wherein said ductwork is segmented into at least two duct parts held together by an attachment means.

21. The workstation of claim 19 wherein said ductwork comprises at least two telescoping segments.

22. The workstation of claim 19 wherein said inlet means comprises a nozzle having a nozzle opening.

23. The workstation of claim 19 including a container means in communication with said vacuum outlet for receiving said air and solid material.

24. The workstation of claim 23 wherein said container means is located in said lower chamber and is selected from the group consisting of a bin and a porous bag.

* * * * *